United States Patent [19]

Hesse

[11] Patent Number: 4,904,116

[45] Date of Patent: Feb. 27, 1990

[54] APPARATUS FOR MAKING TUNNELS IN THE GROUND AND FOR LAYING SUPPLY LINES

[75] Inventor: Alfons Hesse, Lennestadt, Fed. Rep. of Germany

[73] Assignee: Paul Schmidt, Lennestadt, Fed. Rep. of Germany

[21] Appl. No.: 315,416

[22] Filed: Feb. 23, 1989

[30] Foreign Application Priority Data

Mar. 26, 1988 [DE] Fed. Rep. of Germany ..... 3810410
Aug. 4, 1988 [DE] Fed. Rep. of Germany ... 8809959[U]

[51] Int. Cl.[4] ..... E02F 5/10; F16L 1/00

[52] U.S. Cl. ..... 405/183; 405/181; 405/174; 405/182; 37/193; 37/DIG. 18

[58] Field of Search ..... 405/174, 180–184; 37/193, DIG. 18

[56] References Cited

U.S. PATENT DOCUMENTS 516,750 4/1894 Blaine ..... 37/193
2,694,354 11/1954 Roberg ..... 37/DIG. 18 X
3,698,484 10/1972 Kinnan ..... 37/DIG. 18 X
4,179,227 12/1979 Child, Jr. et al. ..... 405/182

FOREIGN PATENT DOCUMENTS 1189602 8/1961 Fed. Rep. of Germany .... 37/DIG. 18
2157259 11/1971 Fed. Rep. of Germany .
2242605 3/1974 Fed. Rep. of Germany .
613027 6/1978 U.S.S.R. ..... 37/DIG. 18

*Primary Examiner*—Randolph A. Reese
*Assistant Examiner*—Arlen L. Olsen
*Attorney, Agent, or Firm*—Toren, McGeady & Associates

[57] ABSTRACT

An apparatus for making tunnels and for laying supply lines in the ground comprises an earth displacing machine which is guided by a sword projecting out of the ground to allow the attachment of a power drive engaging the free end of the sword, and makes it possible to lay the supply lines accurately over long stretches, in particular along walls or the line of roadways or paths or the like.

17 Claims, 7 Drawing Sheets

APPARATUS FOR MAKING TUNNELS IN THE GROUND AND FOR LAYING SUPPLY LINES

TECHNICAL FIELD OF THE INVENTION

The invention relates to an apparatus for making tunnels and for laying supply lines in the ground.

BACKGROUND OF THE INVENTION AND PRIOR ART

It is known to use self-propelled ram boring machines to lay lines without digging trenches. A pneumatically driven ram boring machine known from German Pat. No. 21 57 259 has a striking piston guided in the machine housing and a movable impact tip on which the automatic piston periodically strikes ramming blows. Under the influence of the ramming blows the impact tip moves oscillatingly into the ground and finally draws the housing after it when its stroke is exhausted. Machines of this kind are mainly used to lay supply lines, for example water pipes, electric cables or telephone lines, beneath roads or sidewalks without having to tear up the surface of the ground or sidewalk at the same time. When the ram boring machine moves through the ground it pushes the earth to the side and leaves a tunnel in the ground into which a supply line can be simultaneously or subsequently drawn. However, it is not easy to make a tunnel whose course can be directed. This depends on the composition of the ground, the type of line to be laid and other external influences.

A self-propelled pneumatic ram boring machine known from German Pat. No. 22 42 605 is provided with guiding wings. These are intended to prevent the ram boring machine from moving away from the desired direction; they serve to stabilize the direction and possibly also to guide the ram boring machine on a preselected curved path if the guiding wings are curved. Despite the guiding wings, and although during the forward movement the impact tip shatters or pushes to the side stones or other obstacles in the ground, i.e. drives a passage for the following machine, the possibility cannot be ruled out that the ram boring machine may move away from the desired direction when it strikes an obstacle. Directional deviations of this kind are of little importance in the case of short earth bores, such as for example when crossing under roads and railway embankments, but they do lead to considerable difficulties if accurately targeted and directed earth bores are to be made over long distances. In order to be able to control the direction of advance of the ram boring machine in the case of earth bores extending over long stretches target pits are therefore necessary at intervals.

OBJECT OF THE INVENTION

It is an object of the invention to provide an apparatus with which the above-mentioned disadvantages can be prevented and which enables more accurate positioning and targeting when laying long supply lines, in particular over long stretches such as along walls or along the line of roadways, paths or the like in a simple manner.

SUMMARY OF THE INVENTION

This object is achieved according to the invention by means of an earth displacing machine guided by a sword or blade (hereafter called a sword) that projects from the ground. With the use of an earth displacing machine having a wing it is advantageous if the wing is formed as a guiding sword whose free end preferably projects from the ground in use far enough to allow the attachment of a power drive to act on it. Because the guiding sword arranged on the housing or the impact tip of the machine extends beyond the surface of the ground stabilization of the horizontal direction of advance is achieved since the guiding sword prevents the earth displacement machine from deviating laterally. Tractive force or thrust can also be applied to the free end of the sword by the power drive to prevent the earth displacing machine from deviating from its direction of movement by wandering upwards. As a power drive for applying the thrust a rammer, an excavator or a thrust cylinder can for example be used, and to apply the traction for example a cable winch or lifting winch can be used. In each case the forces applied to the guiding sword prevent the larger resistances in the earth in the region of the guiding sword from diverting the machine upwards out of its direction of advance.

The free end of the sword is preferably mounted in the supporting frame of a carriage. The carriage, which can for example have a base plate that slides on the surface of the ground and accommodates the supporting frame or can roll on the surface of the ground in order to reduce the resistance as the earth displacement machine is driven forwards, assists the accurate direction and targeting of the earth displacement machine. Furthermore, when the surface is flat the base plate holds the earth displacing machine at a constant depth in the ground which depends on the length of the free end of the sword projecting above the surface of the ground at the time. The guiding sword can for example have a vertical slot and can be held in the desired position by means of a screw or clamp bolt inserted through the supporting frame and the slot.

The earth displacing machine guided by the guiding sword and possibly by the base plate of the carriage can be used in particular to lay supply lines, such as for example cables for cable television, over relatively long distances and small depths, for example to lay lines along roadways or along walls of houses or retaining walls. It is however also possible to use the earth displacing machine to lay short supply lines such as those crossing under consolidated surfaces, for example asphalt surfaces; in this case the asphalt surfacing need only be slit open by a joint cutter. The slit aids guidance of the sword and limits lateral deviations.

If the guiding sword is mounted in an adjustable rotary bearing it is no longer necessary to dig a start and finish pit for the earth displacing machine. The guiding sword can, for example, be rotatably mounted in the supporting frame or the earth displacing machine can be rotatably mounted in the guiding sword so that the earth displacing machine can be inclined upwards or downwards either together with the guiding sword or by adjustment relative to the guiding sword, and can thus be inserted into or moved out of the ground on a curve. The rotatable guiding sword or the rotatable earth displacing machine also makes it possible to correct the course in the case of lateral deviations.

It is advantageous to provide a self-propelled pneumatic ram boring machine, preferably one having an eccentric impact tip, with a guiding sword. The ram boring machine works its way automatically through the ground and the tractive force and/or thrust applied above the surface of the ground serves to increase the speed of advance and if necessary at the same time prevents the ram boring machine from deviating upwards. The eccentric arrangement of the impact tip of the ram boring machine however is particularly effective in countering upward deviations. The impact tip can also be rotatably mounted in the machine and be provided with a control means which makes it possible to control the eccentric position of the impact tip from the outside, i.e. to adjust it to any desired eccentricity.

When using a self-propelled pneumatic ram boring machine flow passages for the compressed air driving the ram boring machine can be arranged in the guiding sword. Supply and discharge of compressed air to and from the ram boring machine by way of such inlet and exhaust passages extending into the inside of the machine is advantageous for many reasons. In this way the compressed air hose connected to the rear end of the ram boring machine that is usually necessary can be dispensed with and thus the whole cross-section of the bore can be used for the supply lines to be drawn in. Furthermore there is no need for a long and heavy hose to be pulled along with the ram boring machine and accelerated with it. Thus pressure losses, which increase with increasing length of the hose, do not occur. Since the exhaust air is discharged directly through the sword, utility or service pipes, such as drinking-water pipes, are not contaminated as they are laid by the oil mist contained in the exhaust air. The compressed air supply and removal by way of the guiding sword is not interfered with if, for example when drawing in cables, the tunnel behind the ram boring machine collapses, which can often not be avoided in practice and which in the case of the known machines makes the discharge of compressed air considerably more difficult.

Instead of a self-propelled pneumatic ram boring machine a solid displacing body can be provided with a guiding sword. In this case the impact tip of a rammer arranged on the carriage preferably engages in a rammer attachment and generates the thrust. An example of a suitable rammer for generating the thrust and thus advancing the solid displacing body is that known from DE-OS 33 26 264. This rammer is inserted in the ground to drive in steel pipes, for example protection or line pipes, and has an impact tip moved alternately back and forth in a housing by means of compressed air supplied via a compressed air line and exerting its thrust on the housing.

Not only a solid displacing body but also a self-propelled pneumatic ram boring machine can be combined with an aboveground rammer, i.e. one arranged on the carriage. It is advantageous if the rammer attachment is pivotably mounted so that its inclination to the horizontal and if necessary to the vertical can be adjusted. The force directed against upward deviations of the ram boring machine or the displacing body can be increased or reduced depending on the inclination of the rammer. As well as guiding, the rammer combined with a self-propelled ram boring machine also contributes to increasing the speed of advance.

According to another embodiment it is proposed according to the invention that an aboveground tractive machine, preferably a tractor, is provided with a holding-down sword formed as a guiding sword which dips into the ground and at least one earth displacing machine is connected to the holding-down sword by a traction cable. In this way accurately directed and targeted tunnels can be made in the earth and if necessary supply lines can be laid at the same time by steering the tractive machine pulling the earth displacing machine through the ground. Curved courses can also be followed by steering the tractive machine. Furthermore, it is possible to make the holding-down sword that plunges vertically into the ground and is connected rigidly to the tractor multi-armed and to attach to it—if desired at different levels—a plurality of earth displacing machines or ram boring machines by means of cables.

The earth displacing machine guided through the ground by way of a rigid sword of a tractor can be used in particular to lay supply lines, for example cables for cable television, over relatively long distances at shallow depths, as the earth displacing machine cannot deviate from its direction because the sword holds the traction cable at a predetermined depth.

A self-propelled ram boring machine can advantageously be attached to the tractive machine. The ram boring machine works its way into the ground by itself and the tractive force applied above the surface of the ground by the tractor then serves to increase the speed of advance.

It is advantageous to attach one end of the traction cable to a winch of the tractive machine, and preferably to provide the sword with a guide pulley guiding the traction cable. By means of the winch the distance of the earth displacing machine from the sword of the tractor dipped below the ground can be varied as desired and can be adapted to the local conditions; for example when laying along a curved path the ground displacing machine should be arranged as close as possible behind the guiding sword. In comparison in the case of straight laying paths the distance could be larger and, depending on the speed of the tractive machine or the self-propelled ram boring machine can be varied if necessary during advancing.

BRIEF DESCRIPTION OF THE DRAWINGS

The invention will now be explained in more detail with reference to exemplary embodiments shown in the drawings, in which:

FIG. 2 shows the guiding sword shown in FIG. 1 sectioned along the line II—II,

DETAILED DESCRIPTION OF PREFERRED EMBODIMENTS OF THE INVENTION

Figure 1:
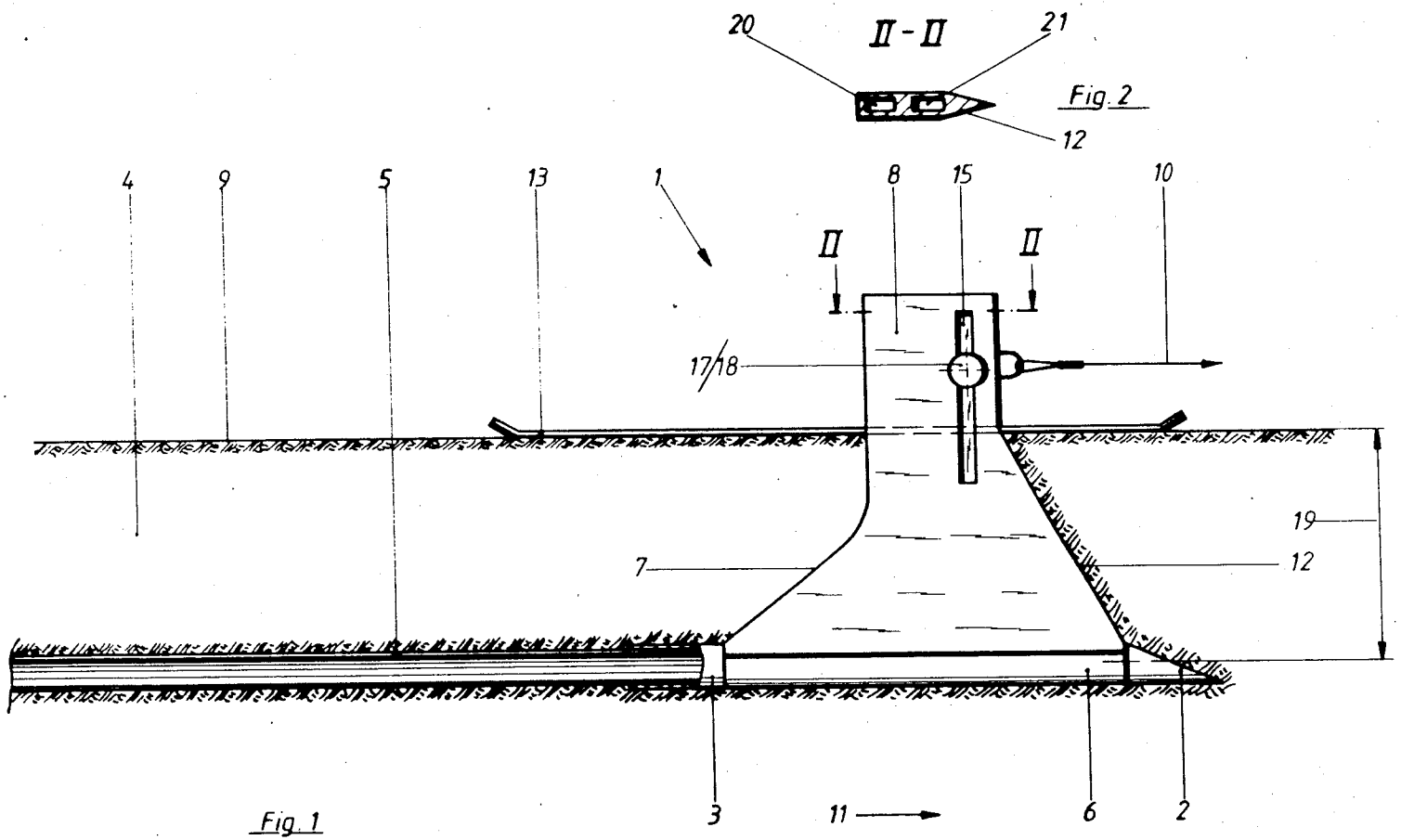
FIG. 1 shows a side elevation of a self-propelled pneumatic ram boring machine located in the ground which is provided with a guiding sword projecting out beyond the surface of the ground.

The earth displacing machine 1 comprises a ram boring machine 6 having an eccentric impact tip 2 at its front end and at its rear end a support 3 having attached thereto supply lines 5 to be drawn into the ground 4. The ram boring machine is provided with a guiding sword 7 which projects with its free end 8 beyond the surface of the ground 9, where a tractive force 10 is applied to the free end 8 of the sword 7. The free end 8 of the guiding sword 7, whose front face 12 facing in the direction of advance 11 is formed as a wedge (see FIG. 2), passes through a carriage 13 (base plate) lying on the surface of the ground 9 and is mounted in a supporting frame 14 (FIG. 4) arranged on the carriage.

Figure 4:
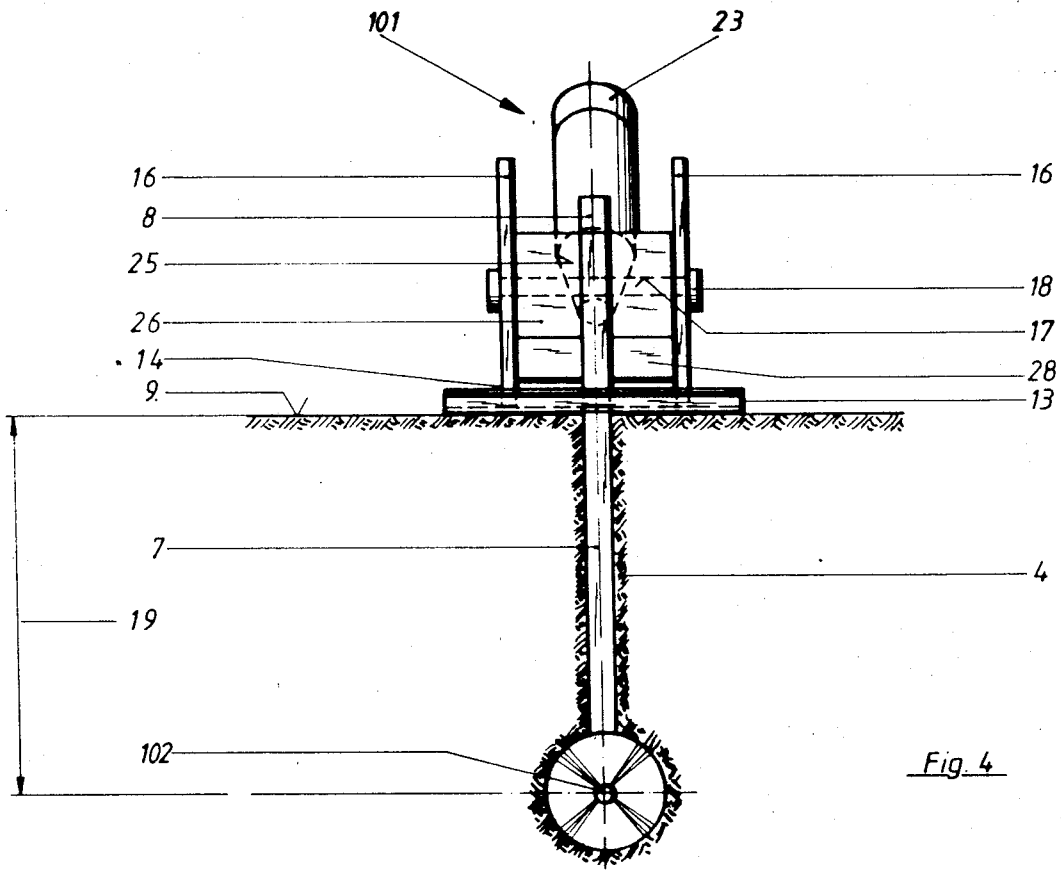
FIG. 4 shows the front view of the ram boring machine combined with a rammer as shown in FIG. 3.

Engaging in a vertical slot 15 in the guiding sword 7 is a clamping bolt 17 bridging, as shown in FIG. 4, the distance between two parallel outer walls 16 of the supporting frame 14. After loosening the head 18 of the clamping bolt 17 the guiding sword 7 can be adjusted vertically either upwards or downwards to an extent determined by the length of the slot 15, and by tightening the head 18 it can be fixed so that the ram boring machine 6 is at the desired distance 19 from the surface of the ground 9 which corresponds to the depth at which the supply line 5 is to be laid in the ground 4.

Figure 5:
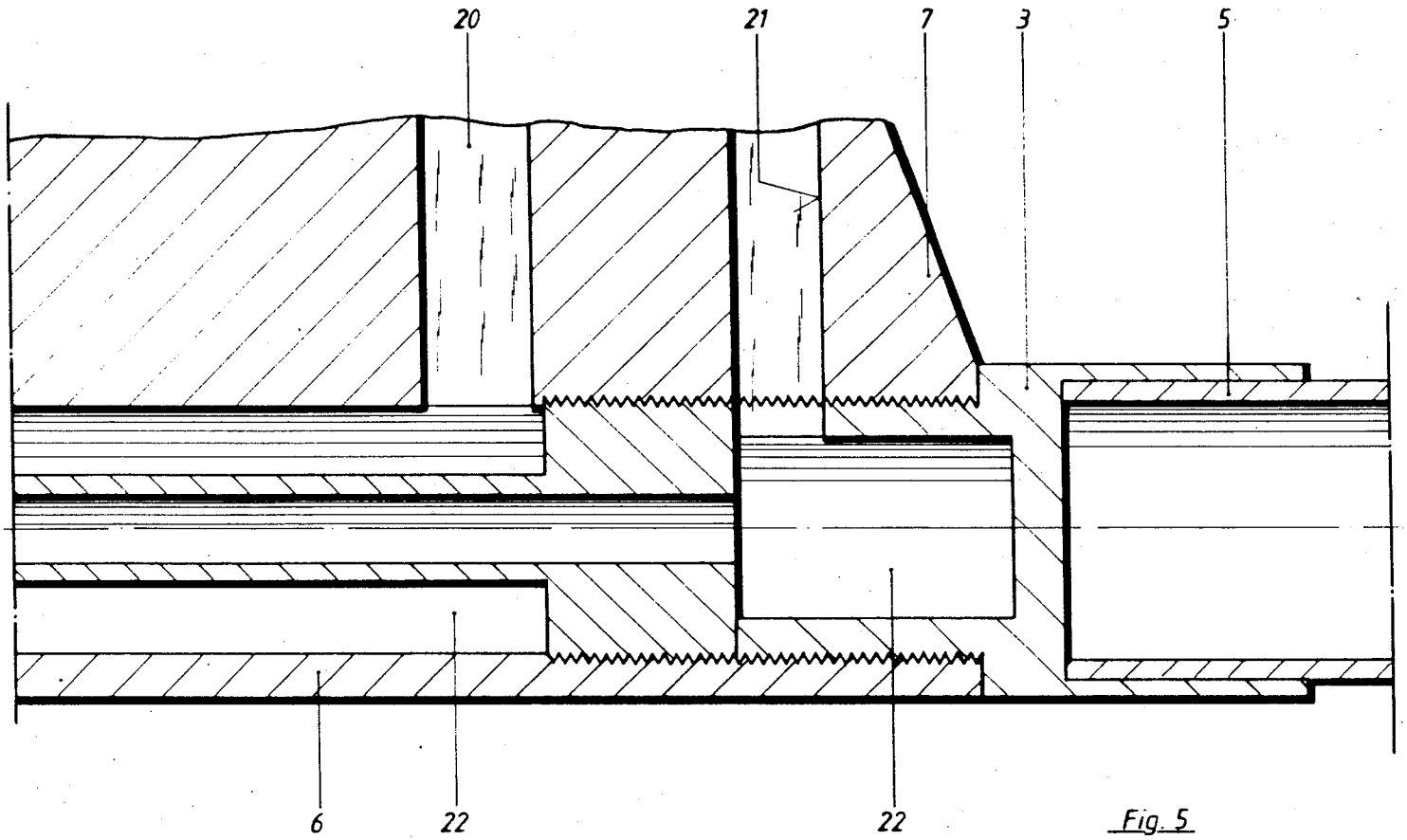
FIG. 5 shows in longitudinal section the detail indicated by "X" in FIG. 3.

In order to supply and exhaust compressed air from the striking piston (not shown) moving the ram boring machine 6 forwards and imparting its impact energy to the housing, the guiding sword 7 is provided with respective inlet and outlet passages 20, 21 (see FIG. 2 in association with FIG. 5) which open into the inside of the housing 22 of the ram boring machine 6.

Figure 3:
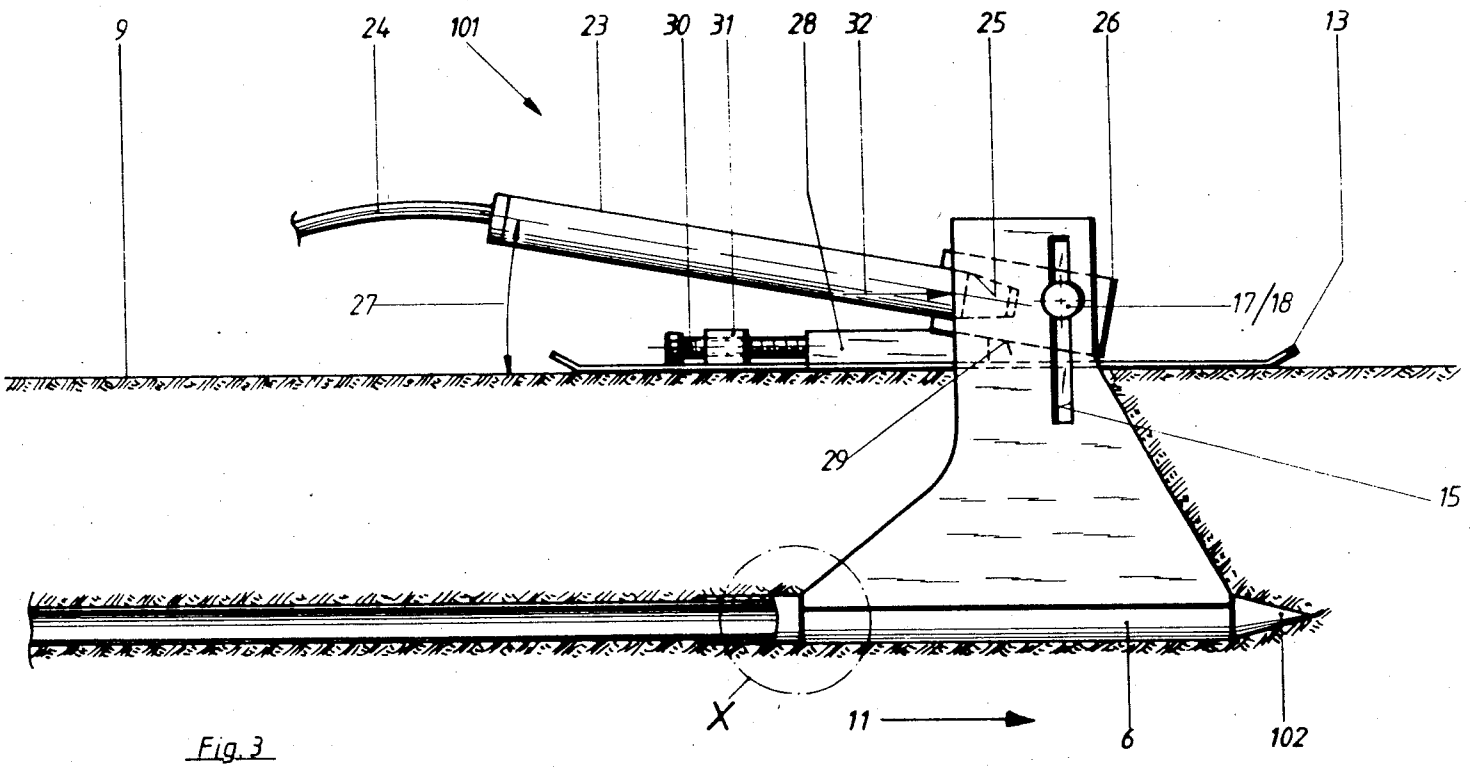
FIG. 3 shows a side elevation of a self-propelled pneumatic ram boring machine as shown in FIG. 1 combined with a rammer arranged on a carriage.

In the earth displacing machine 101 shown in FIG. 3 the ram boring machine 6 has a central impact tip 102 which if desired can be made controllable and be adjusted to an eccentric position. Arranged on the carriage 13 in addition is a rammer 23 which is supplied via a pressure medium hose 24 at the rear from a pressure medium source (not shown), for example a compressor likewise arranged on the carriage, and engages with its impact tip 25 in a rammer attachment 26. The rammer attachment 26 is located between the outer walls 16 of the supporting frame 14 and is pivotably mounted on the clamping bolt 17 arranged in the free end 108 of the guiding sword 107. Because the rammer attachment 26 is pivotable the rammer 23 can be set at an inclination 27 to the horizontal or the surface of the ground 9 so as to prevent the ram boring machine 6 from deviating upwards from its horizontal direction of advance 11 in a vertical plane; the force of the rammer 23 countering the directional deviations of the ram boring machine 6 is stronger the greater the inclination 27. The inclination 27 can be changed via an inclined plane by means of a parallel key 28 on the key surface 29 of which the rammer attachment 26 lies. The parallel key 28 is mounted in a threaded nut 31 with a threaded bolt 30 displacing the parallel key 28 linearly. The power of the rammer 23, which also produces thrust 32 for the ram boring machine 6, should be adjusted relative to the power of the ram boring machine 6 so as to maintain the straight course of the earth displacing machine 101, i.e. of the rammer 23 and the ram boring machine 6.

Figure 6:
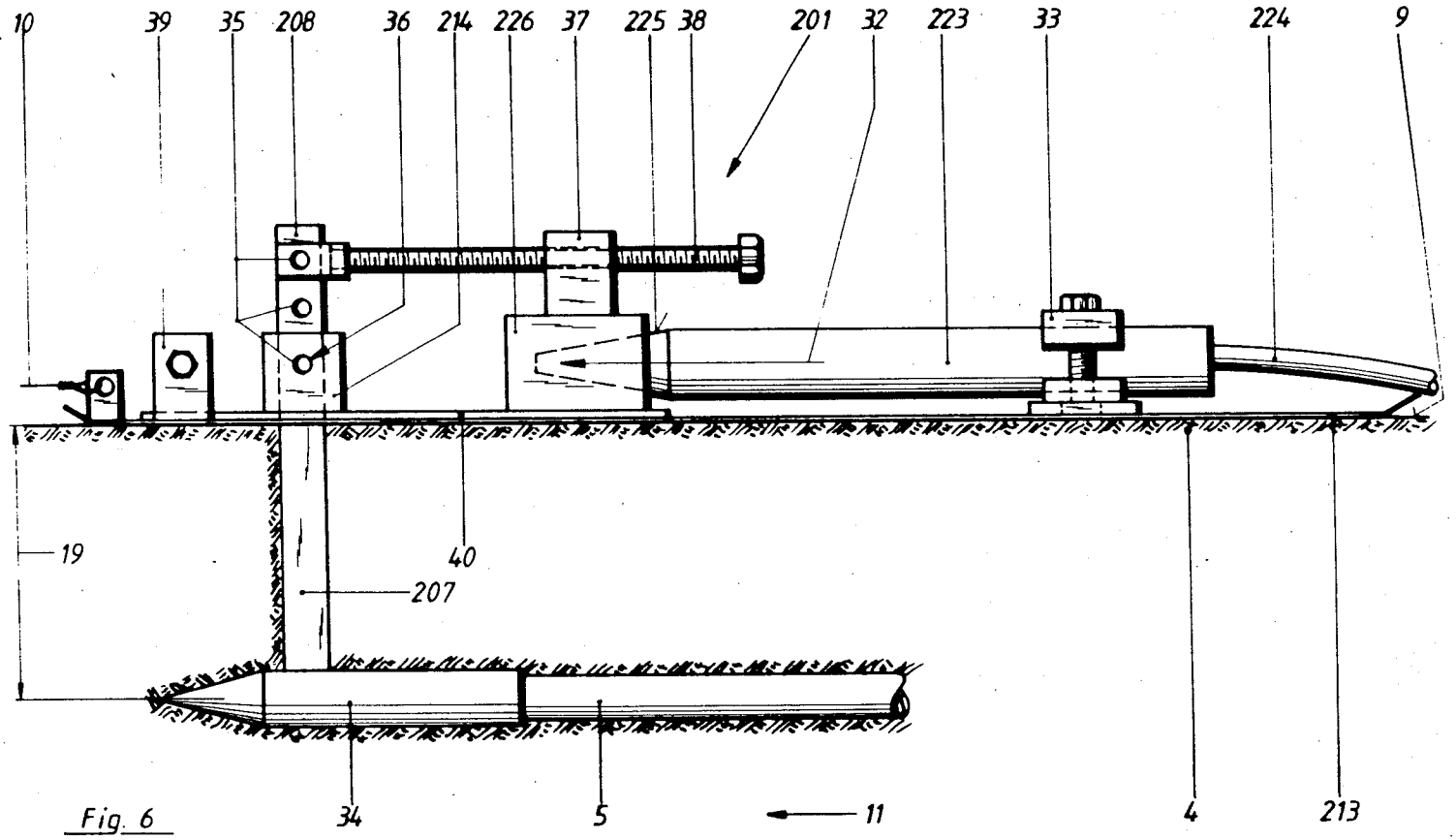
FIG. 6 is a side elevation of a solid displacing machine which is combined with a rammer arranged on the carriage.

In the earth displacing machine 201 shown in FIG. 6 a horizontal rammer 223 arranged on the carriage 213 and having its end facing the supply hose 224 held in a clamp 33 is combined with a solid earth displacing body 34. The free end 208 of the guiding sword 207 projecting beyond the surface of the ground 9 is provided with holes 35 at different levels for adjusting the distance 19 of the displacing body 34 from the surface of the ground 9, or the depth to which it penetrates. A bolt (not shown) inserted through the supporting frame 214 and through a hole 35 both determines the depth of penetration of the displacing body 34 and defines a pivot bearing 36 for the guiding sword 207. Turning an adjusting screw 38 engaging with the free end of the sword 208 and passing horizontally through a threaded block 37 of the carriage 213 rotates the guiding sword 207 in the pivot bearing 36 and tilts the displacing body 34 rigidly attached to the guiding sword 207 into either a downwardly or upwardly inclined position. It is therefore no longer necessary to dig a start and finish pit for the earth displacing machine 201 at the beginning and at the end of the tunnel. The rammer attachment 226 and the supporting frame 214 are attached to a supporting plate 40 of the carriage 213 which can be tilted in a horizontal plane and is arranged in a pivot mounting 39, so that in this manner lateral, i.e. horizontal, deviations of the displacement body 34 can also be compensated. The clamp 33, which is not connected to the pivotable supporting plate 40, is arranged so that it does not prevent the lateral displacements conveyed from the rammer attachment 226 to the rammer 223.

Figure 7:
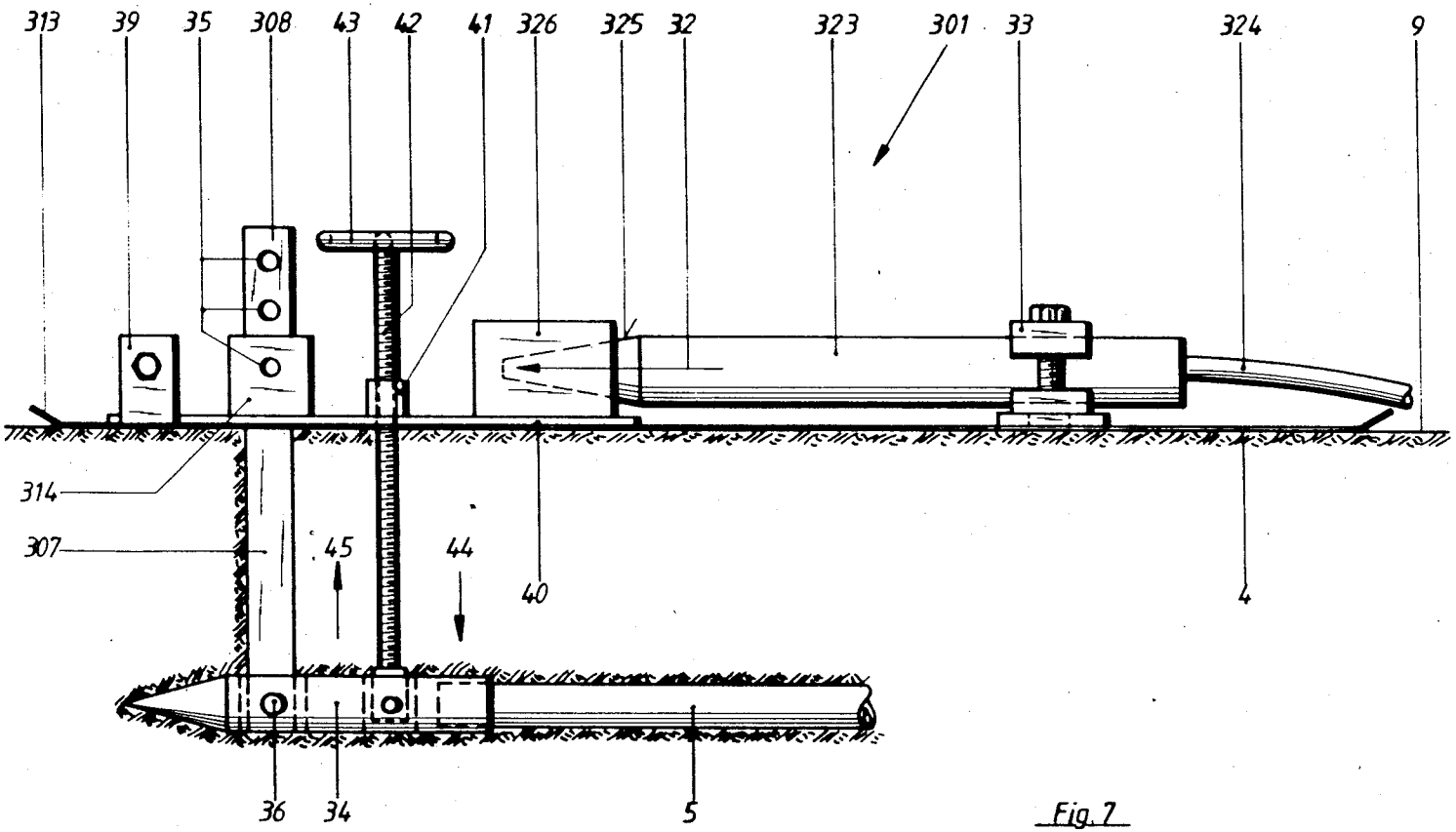
FIG. 7 shows a side elevation of a different earth displacing machine comprising a rammer arranged on a carriage and a solid displacing body working in the ground.

The earth displacing machine 301 shown in FIG. 7 differs from the embodiment shown in FIG. 6 by a different device for adjusting the inclination of the solid displacing body 34. The pivot bearing 36 in this case is not located in the supporting frame 314 for the free end of the sword 308 but directly next to the displacing body 34. Turning an adjusting spindle 42 attached to the displacing body 34 and passing through a threaded attachment 41 of the supporting plate 40 by means of a handwheel 43 tilts the rear end of the displacing body 34 either downwards in the direction of the arrow 44 or upwards in the direction of the arrow 45 about the pivot bearing 36 and thereby aligns the tip of the displacing body 34 either upwards or downwards. For lateral displacement of the earth displacing body 34 the rammer attachment 326 and the supporting frame 314 are arranged on the upper plate 40 of the pivot mounting 39 on the carriage 313.

Figure 8:
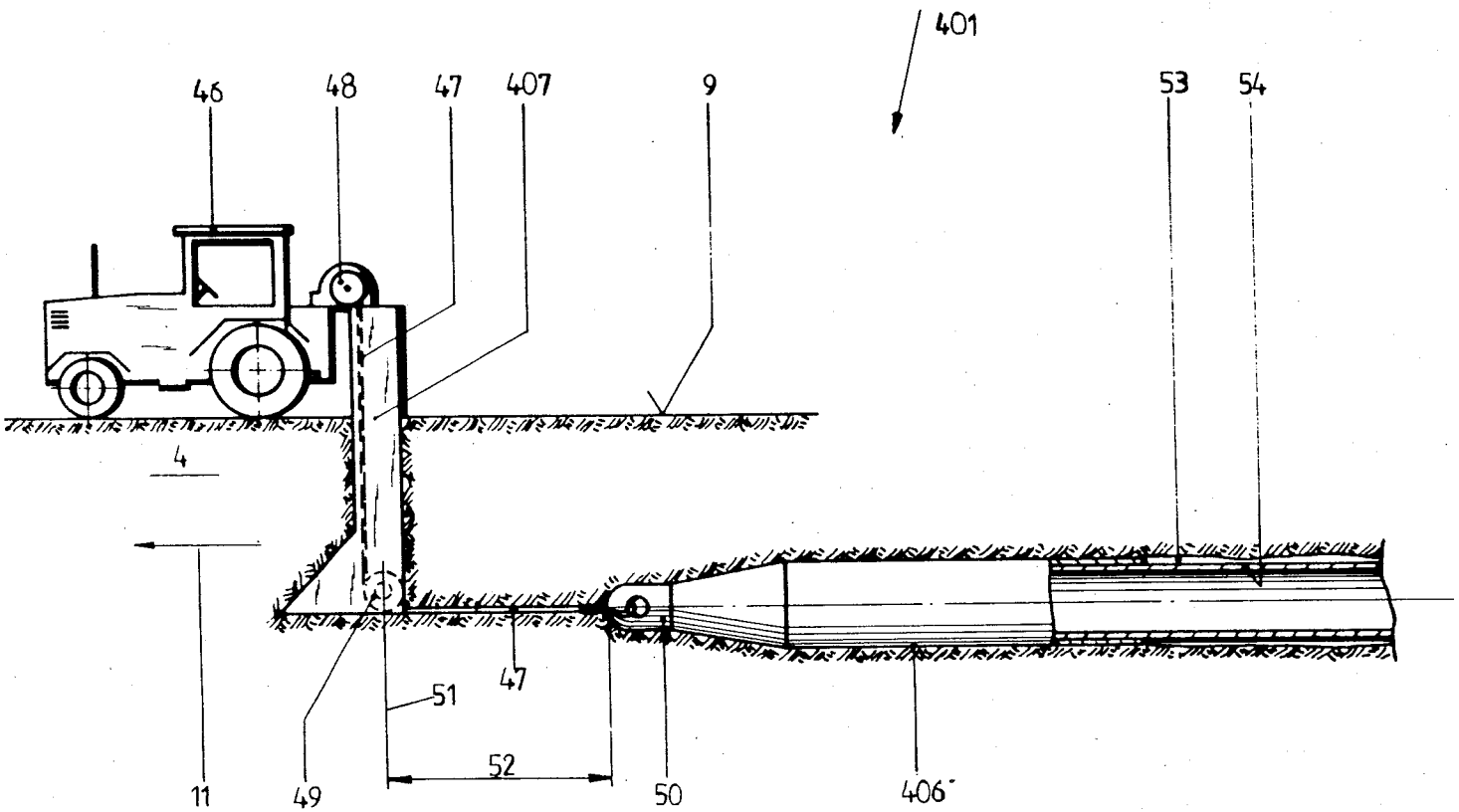
FIG. 8 shows an embodiment having a guiding sword attached to an aboveground truck tractor.

As is shown in FIG. 8 this earth displacing machine 401 has a guiding sword 407, wedge-shaped in the direction of travel or advance 11, that is rigidly fixed to a tractor 46 and plunges through the surface 9 vertically into the ground 4. Extending from the winch 48 of the truck tractor 46 to a self-propelled ram boring machine 406 is a traction cable 47 guided over a guiding roller 49 at the end of the sword and held down by the guiding roller 49 of the sword 407. The free rear end of the traction cable 47 is hooked into an eye 50 in the ram boring machine 406. Between the vertical axis 51 of the guiding roller 49 and the front end of the eye 50 a defined distance 52 is obtained by operating the winch 48.

In order to make a tunnel in the ground and to lay a line the sword 407 in lowered into a start pit (not shown) and there the traction cable 47 is hooked into the eye 50 in the ram boring machine 406. On moving the truck tractor 46 in the direction 11 the ram boring machine 406 is thus drawn behind the guiding sword 407 through the ground 4 thereby forming a tunnel 53, and in the same operation a follower pipe 54 attached to the rear end of the ram boring machine 406 is drawn in as the supply line.

What is claimed is:

1. Apparatus for making for making tunnels in the ground and for laying supply lines in the ground comprising;

an earth displacing machine guided by a sword projecting above the ground, wherein the displacing machine has a wing formed for guiding the sword, said wing having a first portion extending above the ground and a second portion extending below the ground, said first portion having a means for impacting said sword and said second portion having an impact tip.

2. Apparatus according to claim 1 wherein the free end of the sword is mounted in a supporting frame of a carriage.

3. Apparatus according to claim 1 wherein the guiding sword is mounted in an adjustable pivot bearing.

4. Apparatus according to claim 1 wherein said earth displacing machine is a self-propelled pneumatic ram boring machine provided with said guiding sword.

5. Apparatus according to claim 4 which also comprises said means for impacting said sword is a rammer arranged on a carriage with its impact tip engaging in a rammer attachment attached to said sword.

6. Apparatus according to claim 5 wherein said rammer attachment is pivotably mounted.

7. Apparatus according to claim 4 wherein said impact tip of the ram boring machine is eccentric.

8. Apparatus according to claim 4 wherein flow passages for a pressure medium driving the ram boring machine are arranged in said sword.

9. Apparatus according to claim 1 wherein said earth displacing machine is a solid displacing body provided with said guiding sword.

10. Apparatus according to claim 9 which also comprises said means for impacting said sword is a rammer arranged on a carriage with its impact tip engaging in a rammer attachment attached to said sword.

11. Apparatus according to claim 10 wherein said rammer attachment is pivotably mounted.

12. Apparatus according to claim 1 wherein said sword is a holding-down sword attached to an above-ground tractive machine and penetrating into the ground, and at least one earth displacing machine is connected by way of a traction cable to said holding-down sword.

13. Apparatus according to claim 12 wherein said tractive machine is a tractor.

14. Apparatus according to claim 12 wherein said at least one earth displacing machine attached to the traction cable is a self-propelled ram boring machine.

15. Apparatus according to claim 12 wherein said traction cable is attached at one end to a winch of the tractive machine.

16. Apparatus according to claim 12 wherein said sword is provided with a guiding roller guiding said traction cable.

17. Apparatus according to claim 1 wherein said guiding sword has a wedge-shaped front end.

* * * * *